United States Patent [19]

Hosooka et al.

[11] 4,455,800

[45] Jun. 26, 1984

[54] THERMALLY INSULATING SASH FRAME MEMBER

[75] Inventors: Shuuichi Hosooka; Haruo Hori, both of Namerikawa, Japan

[73] Assignee: Yoshida Kogyo K.K., Tokyo, Japan

[21] Appl. No.: 302,704

[22] Filed: Sep. 16, 1981

[30] Foreign Application Priority Data

Sep. 25, 1980 [JP] Japan ..... 55-135336[U]

[51] Int. Cl.³ ..... E04C 1/00

[52] U.S. Cl. ..... 52/309.1; 52/404; 52/731; 49/DIG. 2

[58] Field of Search ..... 52/309.1, 309.14, 404, 52/730, 731, 732; 49/DIG. 1, DIG. 2

[56] References Cited

U.S. PATENT DOCUMENTS

| | | | |
|---|---|---|---|
| 3,579,724 | 5/1971 | Toth | 49/DIG. 1 |
| 3,878,660 | 4/1975 | Jacob | 49/DIG. 1 |

FOREIGN PATENT DOCUMENTS

| | | | |
|---|---|---|---|
| 2531221 | 3/1977 | Fed. Rep. of Germany | 49/DIG. 1 |
| 2724377 | 11/1978 | Fed. Rep. of Germany | 49/DIG. 1 |
| 2909425 | 9/1980 | Fed. Rep. of Germany | 52/730 |
| 1489331 | 7/1967 | France | 49/DIG. 1 |
| 320998 | 5/1957 | Switzerland | 49/DIG. 1 |

*Primary Examiner*—Henry E. Raduazo

*Attorney, Agent, or Firm*—Robert E. Burns; Emmanuel J. Lobato; Bruce L. Adams

[57] ABSTRACT

A thermally insulating sash frame member comprising a pair of spaced interior and exterior metallic bars interconnected by a thermally insulating connector bar. The connector bar includes an elongate main body made of rigid thermally-insulating material and four pad portions made of soft thermally-insulating material, each pad portion extending on and along the main body through its length. The connector bar is gripped at opposite sides by two pair of gripping flanges of the interior and exterior bars, each of the gripping flanges being forced or bent against a respective one of the pad portions.

6 Claims, 2 Drawing Figures

THERMALLY INSULATING SASH FRAME MEMBER

BACKGROUND OF THE INVENTION

1. Field of the Invention:

The present invention relates to a thermally insulating sash frame member, and more particularly to improvements in weatherproofing for such sash frame member.

2. Prior Art:

A known thermally insulating sash frame member comprises a pair of spaced interior and exterior metallic bars interconnected by a thermally insulating connector bar. Each of the interior and exterior bars has a pair of gripping flanges projecting from one of their confronting inner walls. For assembly, the connector bar is placed between the interior and exterior bars, and then the two pairs of gripping flanges are forced or bent to grip the connector bar at opposite sides through the length thereof. However, the connector bar is usually made of rigid material such as rigid polyvinyl chloride, and for this reason, the gripping flanges can engage with the connector bar with only inadequate weathertightness. For the same reason, firm connection between the connector bar and the interior and exterior bars is difficult to achieve.

SUMMARY OF THE INVENTION

According to the present invention, a pair of spaced interior and exterior bars made of matal is interconnected by a connector bar including an elongate main body made of a rigid thermally-insulating material such as rigid polyvinyl chloride and also four pad portions made of a soft thermally insulating material such as rigid polyvinyl chloride. Each of the pad portions extends on and along the main body through the length thereof. The connector bar is gripped at opposite sides by two pairs of gripping flanges of the interior and exterior bars, each of the gripping flanges being forced or bent against one of the pad portions. Because of softness of the pad portions, the gripping flanges can fit or engage with the pad portions with sufficient weathertightness.

It is therefore an object of the invention to provide a thermally insulating sash frame member which enables adequate weatherproofing.

Another object of the invention is to provide a thermally insulating sash frame member in which a pair of interior and exterior bars is interconnected by a connector bar with sufficient firmness.

Other objects and advantages will appear from the following description of an example of the invention, when considered in connection with the accompanying drawings, and the novel features will be particularly pointed out in the appended claims.

DETAILED DESCRIPTION

Figure 1:
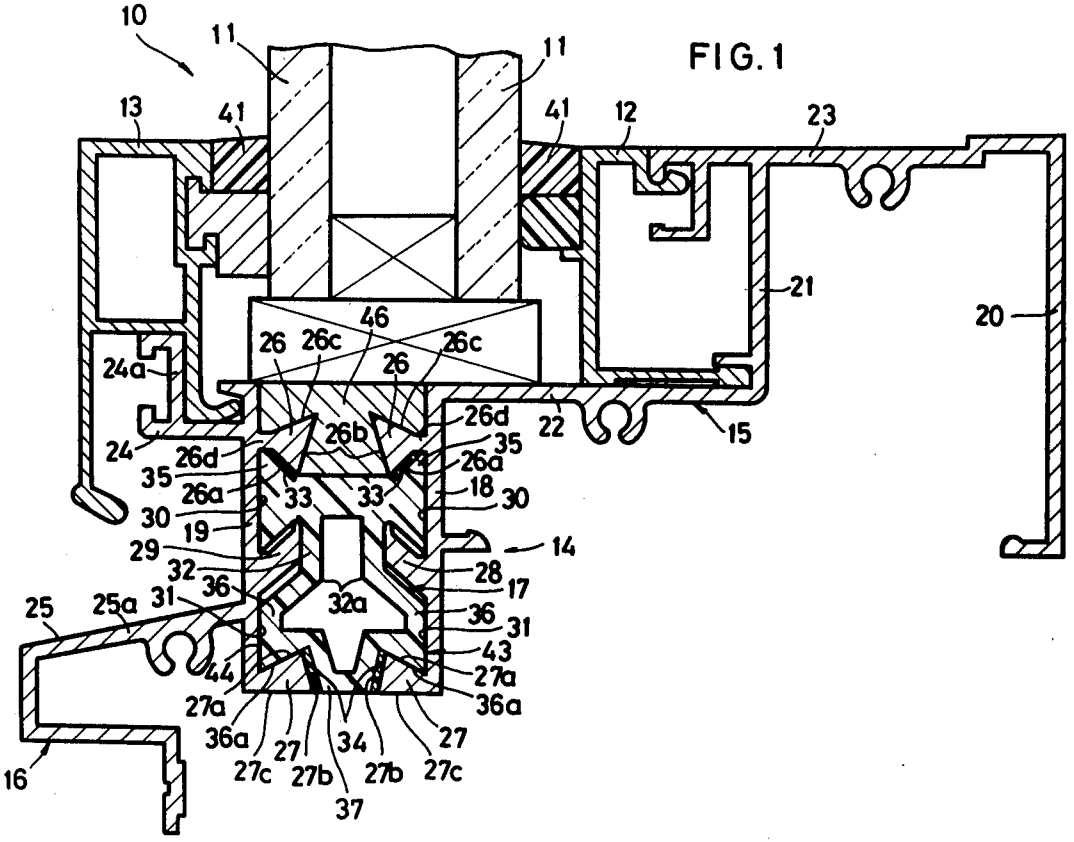
FIG. 1 is a fragmentary, vertical cross-sectional view of a fixed sash window employing a thermally insulating sash frame member according to the present invention.

FIG. 1 shows a lower portion of a fixed sash window generally indicated by the numeral 10. The sash window 10 comprises a thermally insulating sash frame (described below) adapted to be mounted within an opening in a building wall and defining a window opening, and a pair of panes of glass 11 fixedly mounted within the sash frame by means of attachment bars 12,13 via weather strips 41,41. The sash frame includes a pair of upper and lower horizontal members and a pair of vertical side members connected to the horizontal members at their ends. Of these four frame members, only the lower horizontal member 14 (hereinafter called sash frame member) is shown.

The sash frame member 14 comprises a pair of spaced interior and exterior bars 15,16 made of metal such as aluminum and interconnected by a thermally insulating connector bar 17, as described below. The interior and exterior bars 15,16 have a pair of confronting inner vertical walls 18,19, respectively, between which the connector bar 17 is disposed.

The interior bar 15 also has an outer vertical wall 20 disposed remotely from the inner wall 18, and an intermediate vertical wall 21 disposed centrally between the inner and outer walls 18,20. The intermediate wall 21 is connected at opposite edges to the respective upper edges of the inner and outer walls 18,20 by a pair of first and second horizontal walls 22,23. The exterior bar 16 also has a pair of upper and lower walls 24,25 projecting exteriorly from the inner wall 19. The upper wall 24 has an upwardly angled end **24*a* (as viewed in cross section) which serves to support the attachment bar 13. The lower wall 25 has a sloping surface 25*a*** which serves as a throating.

Each of the interior and exterior bars 15,16 has a pair of longitudinal first and second (upper and lower) gripping flanges 26,27 projecting from and spaced vertically or transversely of a respective one of the inner walls. Each of the gripping flanges 26,27 has a generally triangular shape in transverse cross section and thus has three sides **26*a*,26*b*, 26*c* and 27*a*,27*b*, 27*c*. Each of the interior and exterior bars 15,16 also has an upwardly inclined intermediate flange 28,29 projecting from a respective one of the confronting inner walls 18,19 so as to provide a pair of longitudinal channels 30,31 between the upper and lower gripping flanges 26,27. The flanges 26,27,28 of the interior bar 15 are disposed opposite to the flanges 26,27,29, respectively, of the exterior bar 16 in symmetrical or mirrorimage relation. At the interior bar 15, the (end) side 26*b* of the upper gripping flange 26 slopes steeply down to the right. The upper side 26*c* of the same flange 26 gently slopes down to the base portion 26*d*, while the lower side 26*a* slopes up (at about 45°) to the base portion 26*d*. The (end) side 27*b* of the lower gripping flange 27 (of the interior bar 15) steeply slopes down to the left. The upper side 27*a* of the same flange 27 gently slopes down to the right, while the lower side 27*c* lies horizontally. At the exterior bar 16, the (end) side 26*b* of the opposite upper gripping flange 26 slopes steeply down to the left. The upper side 26*c* of the latter flange 26 gently slopes down to the base portion 26*d*, while the lower side 26*a* slopes up (at about 45°) to the base portion 26*d*. The (end) side 27*b* of the lower gripping flange 27 (of the exterior bar 16) steeply slopes down to the right. The upper side 27*a* of the latter flange 27 gently slopes down to the left, while the lower side 27*c*** lies horizontally. The end and upper sides 26*b*,26*c* and 26*b*,26*c* of the opposite upper gripping flanges 26,26 and the upper portions of the interior and exterior bars 15,16, jointly define a longitudinal space 47 (FIG. 2) of a generally T-shape cross section.

The connector bar 17 includes an elongate main body 32 made of a rigid thermally-insulating material such as rigid polyvinyl chloride and also four pad portions 33,33,34,34 made of a soft thermally-insulating material such as soft polyvinyl chloride. Each of the pad portions 33,33,34,34 is in the form of a strip extending on and along the main body 32 through the length thereof and transversely inclined with respect to the inner walls 18,19. The main body 32 has a contour literally complementary to the flanges 26,27,28,29 and thus has four longitudinal projections 35,35,36,36, received one in each of the longitudinal channels 30,30,31,31, the upper longitudinal projections 35,35 each carrying one of the pad portions 33,33. The connector bar 17 is gripped at opposite sides one by each pair of upper and lower gripping flanges 26,27 and 26,27, the upper gripping flanges 26,26 having been forced or bent down one against each of the pad portions 33,33, as described below. Because of softness of the pad portions, one (26*a*) of the three sides of each upper gripping flange 26 fits or engages with a respective one of the pad portions 33,33 with sufficient weathertightness.

The connector bar 17 has a further longitudinal projection 37 carrying a pair of additional pad portions 34,34 one at each side and received in a space between the opposed lower gripping flanges 27,27. One side 27*b* (of the three sides) of each lower gripping flange 27 also weathertightly fits or engages with a respective one of the additional pad portions 34,34. The lower sides 27*c*,27*c* of the lower gripping flanges 27,27 are horizontally aligned with each other.

The main body 32 of the connector bar 17 is in the form of a hollow structure having a longitudinal hole 32*a* of a cross-shaped cross section.

Figure 2:
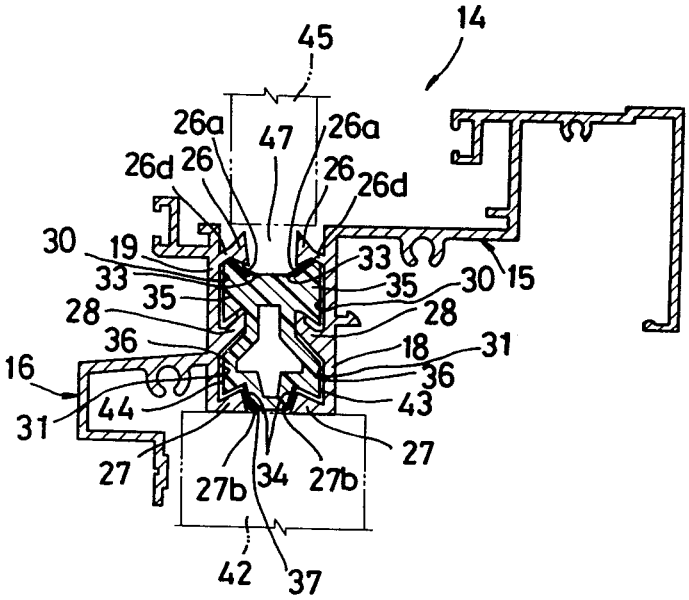
FIG. 2 is a transverse cross-sectional view, on a reduced scale, of the sash frame member, showing the manner in whichthe sash frame member is assembled.

For assembly, as shown in FIG. 2, the interior and exterior bars 15,16 are placed on a base 42 (preferably of a jig) with a space between their confronting inner walls 18,19. The connector bar 17 is then inserted longitudinally into the space between the inner walls 18,19 such that the four longitudinal projections 35,35,36,36 are received in the longitudinal channels 30,30,31,31, respectively. At that time edge surfaces 43,44 of the connector bar 17 are slightly spaced from the respective inner walls 18,19. The pad portions 38,38 also are slightly spaced from the respective sides 27*b*,27*b* of the lower gripping flanges 27,27.

Subsequently, the upper gripping flanges 26,26 are forced (or bent at their neck portions 26*d*,26*d*) down by a ram or punch 45 against the connector bar 17 to such an extent that the lower side 26*a* (of the triangular shape) of each gripping flange 26 fits or engages with a respective one of the pad portions 33,33 with adequate tightness. Before having been forced of bent down, the upper gripping flanges 26,26 had been in upwardly-angled or stand-up position as shown in FIG. 2. This downward force causes the inclined lower side 26*a* of each upper gripping flange 26 to slide downwardly along the inclined surface of a respective one of the pad portions 33,33, thus bringing upper portions of the confronting inner walls 18,19 closely to the connector bar 17. At the same time this downward forcing also causes the inclined lower side 36*a* of each longitudinal projection 36 to engage with a respective one of the inclined upper sides 27*a*,27*a* of the lower gripping flanges 27,27 and to slide downwardly along the same, thus bringing the confronting inner walls 18,19 in contact with or closely to the edge surfaces 43,44 of the connector bar 17. As a result, the side 27*b* of each lower gripping flange 27 is brought into engagement with a respective one of the pad portions 34,34 with sufficient tightness. The connector bar 17 has thus been gripped at opposite sides by the two pairs of gripping flanges 26,27 and 26,27 with a space 47 therebetween along the top of the connector bar 17. The space 47 is filled with a thermally insulating material 46 (FIG.1) such as foamed polyurethane.

With this arrangement, because the main body 32 of the connector bar 17 is made of rigid thermally-insulating material, the interior and exterior bars 15,16 can be interconnected by the connector bar 17 with sufficient firmness. Further, since the pad portions 33,34 of the connector bar 17 are made of soft thermally-insulating material, the gripping flanges 26,27 and 26,27 of the interior and exterior bars 15,16 can fit or engage with the pad portion 33,34 and 33,34, respectively, with adequate weathertightness.

It will be understood that various changes in the details, material, and arrangements of parts, which have been herein described and illustrated in order to explain the nature of the invention, may be made by those skilled in the art within the principle and scope of the invention as expressed in the appended claims.

What is claimed is:

1. A thermally insulating sash frame member, comprising:

a pair of spaced opposed elongate metal walls having respective facing surfaces, each of said walls having a respective lower flange extending lengthwise therealong and extending toward the other of said walls, each of said walls having a respective upper flange extending lengthwise therealong and extending toward the other of said walls, and each of said walls having an intermediate flange extending lengthwise therealong between said upper and lower flanges, said upper flanges each having a lower surface sloped downwardly in a direction toward the other of said walls, and said lower flanges each having an end surface facing the other of said walls and sloped downwardly in a direction toward the other of said walls;

a thermally insulative rigid connector bar disposed between and connected said pair of walls, said connector bar extending only up to said upper flanges and having a pair of upper sloped surfaces each confronting and generally parallel to a respective one of said lower sloped surfaces of said upper flanges, and said connector bar having a pair of lower sloped surfaces each confronting and generally parallel to a respective one of said sloped end surfaces of said lower flanges;

a respective resilient thermally insulative pad disposed between each of the confronting and generally parallel flange and connector surfaces;

said upper and lower flanges being in a stressed condition for pressing toward the confronting and generally parallel connector bar surfaces to maintain said pads in a compressed condition, and a layer of thermally insulative material between said walls covering said connector bar and said upper flanges and filing the space between said walls above said connector bar.

2. A sash frame member according to claim 1,said connector bar being made of rigid polyvinyl chloride.

3. A sash frame member according to claim 1, said insulative pads being made of soft polyvinyl chloride.

4. A sash frame member according to claim 1, in which said opposed walls are spaced parallel to one another, each said pad portion being in the form of a strip transversely inclined with respect to said walls.

5. A sash frame member according to claim 4, each of said flanges having a triangular shape in transverse cross section, one of the three sides of each said flange weathertightly engaging with a respective one of said pad portions.

6. A sash frame member according to claim 1, said connector bar having at its lower side an additional longitudinal projection carrying pad portions one at each side.

* * * * *